United States Patent [19]

Fox

[11] Patent Number: 4,786,530

[45] Date of Patent: Nov. 22, 1988

[54] FINISHING SIZE COMPOSITION AND METHOD FOR MAKING AND USING SAME

[75] Inventor: Charles J. Fox, Atlanta, Ga.

[73] Assignee: Penick & Ford, Limited, Cedar Rapids, Iowa

[21] Appl. No.: 89,066

[22] Filed: Aug. 25, 1987

[51] Int. Cl.[4] ..... B05D 3/02

[52] U.S. Cl. ..... 427/384; 106/213; 428/289

[58] Field of Search ..... 427/374.1, 381, 384; 536/50, 111; 106/213; 428/289

[56] References Cited

U.S. PATENT DOCUMENTS 4,373,099 2/1983 Hubbard et al. ..... 536/50

4,421,566 12/1983 Hasuly et al. ..... 536/50

OTHER PUBLICATIONS

"Chemistry & Industry of Starch" Kerr, 1952, pp. 570–575.

"Industrial Gums" Whistler 1973, pp. 654–655.

*Primary Examiner*—Theodore Morris

*Attorney, Agent, or Firm*—Marshall, O'Toole, Gerstein, Murray & Bicknell

[57] ABSTRACT

A finishing size composition and method of making and using same as a finishing size to control the dimensional stability of woven fabric in which a paste comprising a noncongealing, hydrophillic, starch ether or ester or combinations thereof exhibiting five gram alkali fluidity from about 10 millimeters to about 97 millimeters is padded to fabric at a temperature of less than 140° F. after which the padded fabric is dried and has an add-on weight increase of from about 0.5–4.5%.

8 Claims, No Drawings

FINISHING SIZE COMPOSITION AND METHOD FOR MAKING AND USING SAME

FIELD AND BACKGROUND OF THE INVENTION

This invention relates to a sizing composition utilized in the finishing process for textiles and more particularly, to an improved textile finishing size composition comprising a noncongealing, hydrophillic, starch ether or ester or combinations thereof exhibiting a five gram alkali fluidity from about 10 milliliters to about 97 milliliters.

In the course of manufacturing textiles, fiber materials are weaved together to form a cloth after which the cloth is subjected to a finishing process which prepares the textile cloth for subsequent use either by an ultimate user or a process manufacturer such as a garment manufacturer. Many sizing materials are used in the finishing of textile fabrics to impart a number of properties. The main property sought to be controlled is elongation of the fabric to achieve uniform shrinkage control. While other properties such as puncturing, stiffness, and tearing on both axes are pertinent, the primary property that a fabric must possess is dimensional stability which requires that the fabric have uniform elongation and bias stability to enhance uniform shrinkage control. If a fabric does not possess uniform elongation, it will stretch in a non-uniform manner which, in the case of a garment, can result in puckering or, in the case of a garment manufacturer, uneven assembly of the pattern components.

It is known in the art that if a fabric does not possess the requisite dimensional stability, materials can be added to achieve such stability. For example, polyvinyl alcohol (PVA) and thin-boiling starches have been utilized as finishing size materials. It has been found, however, that while thin-boiling starches provide desired dimensional stability, they must be maintained and utilized at a temperature of not less than 180° F. Failure to maintain thin-boiling starches below this temperature results in the starches becoming congealed which adversely affects the ability of the starch to pad the fabric. Additionally, the congealed starch loses adhesive strength. Unfortunately, while the starch will cook at the 180° F. temperature, other materials that may be added during the sizing preparation, e.g., anionic wetter (DOSS), become unstable at this temperature whereby the desired properties for these additional materials are not achieved. Similarly, while PVA can be utilized, it is relatively expensive and, in some instances, gives irregular appearance to a fabric upon subsequent fabric washing or cleaning.

Further, it has been found, in some instances, that while dimensional stability of a fabric can be achieved by the use of thin-boiling starches and PVA, the dimensional stability is not uniform throughout the fabric and that non-uniform elongation occurs.

What is desired is to have a material which can be utilized in a finishing operation to provide the desired fabric properties including uniform dimensional stability which is relatively inexpensive and can be utilized at temperatures less than 180° F. so as not to adversely affect or destabilize other materials added during the sizing preparation. Additionally, it is important that the material, when added, does not, upon subsequent fabric cleaning or washing, provide an irregular fabric appearance.

SUMMARY OF THE INVENTION

The invention disclosed and claimed herein serves to obviate the the disadvantages associated with the prior art. Briefly, the present invention relates to a finishing size composition comprising a noncongealing, hydrophillic, starch ether or ester or combinations thereof exhibiting a five gram alkali fluidity from about 10 milliliters to 97 milliliters. Preferably, the finishing size composition is a hydroxyalkyl ether modified starch derivative.

The finishing size material of the present invention is relatively inexpensive when compared to the PVA sizing agent. While the modified starch derivative of the present invention is cooked at 180° F. or higher, it can ultimately be cooled to less than 140° F. for use in a sizing preparation, such that other materials can be added in the finishing preparation without destabilization which occurs at temperatures of over 140° F. In the event heat sensitive additives are not required for the fabric, the modified starch derivative can be utilized at its cooking temperature.

Further the modified starch derivative of the present invention achieves increased dimensional stability in that there is uniform elongation of the treated fabric. Moreover, upon subsequent washing or cleaning of the fabric finished with the sizing material of the present invention, no irregular and undesired fabric appearance occurs. Fabric treated with the sizing material of the present invention has no masking effect on the appearance of the fabric.

Additionally, it is believed that the finishing size of the present invention facilitates the controlled sanforization of the fabric by dimensionally stabilizing the fabric.

DETAILED DESCRIPTION OF THE INVENTION

According to the invention, a finishing size containing a noncongealing hydrophillic starch ether or ester or combination thereof exhibiting a five gram alkali fluidity from about 10 milliliters to about 97 milliliters, achieves one or more of the following objectives:

a finishing size that serves to provide structural stability to woven fabric;

a finishing size that serves to control elongation of the woven fabric;

a finishing size that serves to provide the requisite dimensional stability and other requisite physical properties of the finished sized fabric;

a finishing size that, in use with other additives normally added to the finishing size, is temperature compatible with these additives; and, a finishing size which is relatively stable, easy to handle, exhibits good shelf life and which may be applied to woven fabric at low temperatures.

According to the invention, a finishing size contains a noncongealing hydrophillic starch ether or ester or combination thereof exhibiting an alkali fluidity of from about 10 milliliters to about 97 milliliters for a five gram sample. Preferably the finishing size of the present invention exhibits alkali fluidity of from about 75 milliliters to about 85 milliliters for a five gram sample.

Further, according to the invention, a finishing size contains a hydroxyalkyl ether modified starch derivative.

More particularly, the finishing size of the present invention contains a 2-hydroxyethyl ether modified starch.

The alkali fluidity is determined by utilizing a method described in Kerr, *Chemistry and Industry of Starch*, 2d ed., Chp. 6, "Evaluation of Modified Starches in Practice", Academic Press (1950). The Kerr method, which uses five gram samples, was modified to use 10 gram and 20 gram sample sizes to achieve greater accuracy in the measurement of the alkali fluidity as the hydroxyalkyl ether modified starch derivatives of the present invention decrease in molecular weight due to increasing acid modification of the starch backbone. It has been found that the optimal alkali fluidity for the hydroxyalkyl ether modified starch derivative used in the present invention exhibits a fluidity of about 58 milliliter to about 64 milliliter for a ten gram sample.

The hydroxyalkyl ether modified starch derivative used in the finishing size of the present invention is provided in a granular form. Prior to the finishing step, the hydroxyalkyl ether modified starch derivative is slurried with a suitable solvent, preferably water, to obtain a concentration of about 0.5% to about 16% solids, preferably 1% to about 8% solids. The slurry is heated from about 165° F. to about 212° F. for about 15 minutes to form the finishing size or paste of the present invention. Alternately, the slurry may be jet cooked in a conventional manner. Following heating, the finishing size is cooled less than about 140° F. The cooling may be achieved by adding sufficient water to obtain a final concentration of the hydroxyalkyl ether modified starch derivative of about 1% to about 8% solids.

Unstable additives, which may be required, are added to the cooled paste. Stable additives can be either added to the cooled paste or the slurry.

Finish sizing may be carried out by padding the finishing size of the present invention onto the fabric such that the finishing size is applied to all of the interstices between the warp yarn and the filling yarn. Padding is achieved by feeding the fabric through a bath containing the finishing size and subsequently removing excess finishing size from the fabric by passing it through a pair of opposed squeeze rollers. It is important to provide sufficient agitation during the slurrying, heating and padding to maintain proper viscosity and paste uniformity.

After padding, the finished sized cloth is conventionally dried.

The finished sized fabric, following drying, exhibits a weight increase of from about 0.5% to about 4.5% due to the "add on" of the hydroxyalkyl ether modified starch derivative used in the finishing size.

It is appreciated that hydroxyalkyl ether includes the hydroxyethyl and hydroxypropyl ethers. Other starch ethers contemplated for use in the finishing size of the present invention include carboxy methyl, tertiary amino alkyl and quaternary amino hydroxyalkyl and starch esters such as acetate, succinate, alkyl succinate, or the like either singularly or in combination with each other so long as such combinations do not exhibit congealing between room temperature and about 140° F.

While the preferred hydroxyalkyl ether modified starch is made from corn or potato starch, it is appreciated that other cereal starches such as waxy maize, high amylose, wheat, rice and the like or tubular starches such as tapioca and the like, or fractions of amylose or amylopectin therefrom may be used.

EXAMPLES

The following specific examples are provided in order to clearly illustrate the practice of the invention but are not to be considered to limit the scope of the invention in any way.

In the following examples fabrics were finished sized with a finishing size made in accordance with the present invention. Following the finishing operation, visual observations were made to determine the dimensional stability of the finished size fabric in accordance with industry testing procedures such as ASTM-3107-75.

EXAMPLE I

In this Example, 75 lbs. of a 2-hydroxyethyl ether modified starch having approximately 10% by weight water content, exhibiting a ten gram alkali fluidity of 61 milliliters, was added to 175 gallons of water and brought close to boiling by steam injection to form a paste. The resulting finishing size or paste was diluted with sufficient water to obtain a total solids of 4% and a temperature of less than about 140° F. The temperature of the diluted paste was maintained at about 120° F. to about 140° F. and following dilution of the paste, conventional additives including 37.5 lbs. of a softener, Stansoft 1012 manufactured by KPL, Inc., Greenville, S. C., and 15 lbs. of a wetter were added to the cooled paste. The finishing size was then padded onto 100% cotton 10 oz. canvas. Sufficient agitation was provided to maintain uniformity of the paste. Following drying, there was an average weight increase of the padded fabric of about 1.4% due to add-on of the finishing size. The finishing size was successfully applied to the canvas at these temperatures of 120°-140° F. The dried sample was then sanforized. The finished sized canvas was reported to exhibit acceptable dimensional stability in accordance with industry testing procedures.

EXAMPLE II

In Example II, 100 lbs. of a 2-hydroxyethyl ether modified starch having approximately 10% by weight water content, exhibiting a ten gram alkali fluidity of 61 milliliters was added to 140 gallons of water and brought close to boiling by steam injection to form a paste. The resulting finishing size or paste was diluted with sufficient water to obtain a total solids of 4.4% and a temperature of less than about 140° F. The temperature of the diluted paste was maintained at about 120° F. to about 140° F., and, following dilution of the paste, conventional additives including 30 lbs. of a softener and 20 lbs. of DOSS, a sulfo succinate type of wetter, were added to the cooled paste which was maintained at a temperature below the degradation temperature of the DOSS.

We claim:

1. A method of preparing a finished size fabric said method comprising:

(a) preparing a slurry comprising a noncongealing hydrophilic starch exhibiting a five gram alkali fluidity of from about 10 milliliters to about 97 milliliters and a solvent;

(b) heating the slurry to at least 165° F. to form a finishing size paste;

(c) cooling the finishing size paste of step (b) to at least 140° F.;

(d) padding a fabric with the finishing size paste of step (c);

(e) removing excess finishing size paste from the contacted fabric, and (f) drying the contated fabric.

2. The method of claim 1 wherein the noncongealing hydrophillic substituted starch derivative exhibits a five gram alkali fluidity of from about 10 milliliters to about 97 milliliters and a concentration from about 0.5% to about 16% solids.

3. The method of claim 2 wherein the dried padded fabric exhibits a weight increase of from about 0.5% to about 4.5%.

4. The method of claim 1 wherein the substituted starch derivative is selected from at least one of the group consisting of hydroxyethyl ether modified starch, hydroxypropyl ether modified starch, carboxymethyl ether modified starch, tertiary amino alkyl ether modified starch, quartenary amino hydroxyalkyl ether starch, acetate ester modified starch, succinate ester modified starch and alkyl succinate ester modified starch.

5. The method of claim 2 wherein the noncongealing hydrophillic substituted starch derivative comprises 2-hydroxyethyl ether modified starch exhibiting a 10 gram alkali fluidity of from about 58 milliliters to about 64 milliliters.

6. The finished size fabric prepared by the method of claim 5.

7. The finished size fabric prepared by the method of claim 1.

8. A fabric having a padded finishing size comprising 2-hydroxyethyl ether modified starch exhibiting a 10 gram alkali fluidity of from about 58 milliliters to about 64 milliliters.

* * * * *

UNITED STATES PATENT AND TRADEMARK OFFICE

CERTIFICATE OF CORRECTION

PATENT NO. : 4,786,530

DATED : November 22, 1988

INVENTOR(S) : Charles J. Fox

It is certified that error appears in the above-identified patent and that said Letters Patent is hereby corrected as shown below:

In column 1, line 43, change "below" to "above".

In column 2, line 6, strike one of the "the" words.

In column 3, line 66, change "tubular" to "tuber".

In column 5, line 3, change "contated" to "contacted".

Signed and Sealed this

Twentieth Day of June, 1989

*Attest:*

*Attesting Officer*

DONALD J. QUIGG

*Commissioner of Patents and Trademarks*